US005341797A

United States Patent [19]

Maruyama

[11] Patent Number: 5,341,797

[45] Date of Patent: Aug. 30, 1994

[54] LIQUID HEATING APPARATUS

[76] Inventor: Noboru Maruyama, 2-26-14 Shirasagi, Nakano-ku, Tokyo, Japan

[21] Appl. No.: 94,493

[22] Filed: Jul. 19, 1993

[30] Foreign Application Priority Data

Jul. 22, 1992 [JP] Japan ..... 4-194399
Aug. 11, 1992 [JP] Japan ..... 4-214267

[51] Int. Cl.[5] ..... F24H 1/00; F22B 5/00

[52] U.S. Cl. ..... 126/373; 165/157; 122/16; 122/17; 126/344; 126/390

[58] Field of Search ..... 126/373, 344, 365, 390, 126/391, 392, 101, 103; 122/16, 17; 165/157

[56] References Cited

U.S. PATENT DOCUMENTS 3,717,748 2/1973 Imler ..... 126/101 X
4,424,768 1/1984 Testa ..... 122/17 X
4,632,066 12/1986 Kideys ..... 122/17 X
4,790,268 12/1988 Eising ..... 122/17

*Primary Examiner*—Larry Jones
*Attorney, Agent, or Firm*—Gunn & Kuffner

[57] ABSTRACT

In a liquid heating apparatus according to the present apparatus, an external drum comprising a dual wall is provided in a water tank, the external drum has a combustion gas distribution chamber formed in the dual wall, an internal drum having a combustion chamber is provided therein and a partitioned water chamber is formed therebetween, an upper communicating tube penetrating the external drum and communicating to inside of the water tank and a lower communicating tube communicating the lower section of the partitioned water chamber to the base of the water tank are provided in the upper and lower sections of the partitioned water chamber respectively, a draft tube communicating a combustion chamber to a combustion gas distribution chamber is provided in the upper section of the partitioned water chamber, an exhaust tube opened to the outside of the water tank is provided in the lower section of the external drum, and a combustor support cylinder penetrating the external drum and the partitioned water chamber and thrusting from the side wall of the internal drum to outside of the water tank is provided.

9 Claims, 10 Drawing Sheets

LIQUID HEATING APPARATUS

BACKGROUND OF THE INVENTION

This invention relates to a liquid heating apparatus in which a heat exchanger, such as boiler, making use of combustion gas up/down-draft method is installed within a water tank.

The liquid heating apparatus described above includes those proposed by this applicant and disclosed in (A) the Japanese Utility Model Publication No. 44093/1973 and (B) the Japanese Utility Model Publication No. 15168/1976. What is disclosed in (A) is the one as shown in FIGS. 9 to 12, with a heat exchanger 21 provided in a water tank 22; said heat exchanger 21 comprising a partitioned water chamber 25 provided within an internal void section surrounded by a heat receiving wall 23 with the upper section and both sides of the lower section communicated with a communicating tube 24 and a water through hole 30 respectively to a water tank 22, a combustion chamber 26 communicated to a gas up-draft chamber 29 having a narrow upper section formed in one side thereof and a gas down-draft chamber 27 having a narrow lower section formed in the other side with upper sections of the two chambers 27 and 29 communicated to each other with gas through holes 28 formed in both sides of the communicating tube 24, a combustor 33 provided in the lower section of the combustion chamber 26 with an air supply path 31 to the combustion chamber 26 and an exhaust path 32 to the gas down-draft chamber 27 each provided in the lower section thereof.

Description is made hereinafter for phenomena in up/down-draft of combustion gas in the heat exchanger 21 as described above. In a gas combustion path having the gas up-draft chamber 29 shown in FIG. 11 and the gas down-draft chamber 27 having the same height H as that of the gas up-draft chamber, it is known that an internal draft power Pch as expressed by the following equations (1) and (2) is generated, assuming a heat generating point U, a middle point M, and an exhaust point $$D: Pch=(\gamma d-\gamma u)\times H \quad (1)$$

$$Pch=(PH/R)(1/Td-1/Tu) \quad (2)$$

Herein;

γd: Specific weight of combustion gas in the gas down-flow chamber 27

γu: Specific weight of combustion gas in the gas up-flow chamber 29

H: Height of the middle point M from the heat generating point U

P: Pressure of the combustion gas

R: Constant for the combustion gas

Td: Temperature of the combustion gas in the gas down-flow chamber 27

Tu: Temperature of combustion gas in the gas up-flow chamber 29

As Tu is always higher than Td (Tu>Td), when the heat exchanger 21 is working, namely when the combustor 33 is working, (1/Td−1/Tu)>0, and the combustion gas flows from the heat generating point U to the middle point M and to the exhaust point D. In contrast to it, when operation of the heat exchanger 21 is down, Tu=Td=Temperature of peripheral water, and for this reason the internal draft power Pch=0, so that a combustion gas in a combustion gas path stops flowing and resides therein, which is useful in preventing cool air from coming in from the outside and keeping the internal temperature at a level.

What was described above is based on this principle, and a combustion gas generated within the combustion chamber 26 goes up in the gas up-draft chamber 29 and then goes down in the gas down-draft chamber 27 radiating heat with the temperature of the gas becoming lower and the weight becoming heavier and is exhausted through a flue 32 from the exhaust path 34 to the outside, and in this process the combustion gas contacts the heat receiving wall 23 and walls of the partitioned water chamber 25 to heat water within the water tank 22 so that the heat exchange is high, temperature of the water goes up rapidly, temperature drop of a combustion gas while flowing is large with the down-draft fluidity raised and the draft function promoted. In addition as the two paths 31 and 32 adjoin each other, a supply air flowing in the air supply path 31 is heated by exhaust gas flowing in the gas exhaust path 32 with the combustion efficiency raised, which is another merit of the system above.

In the apparatus disclosed in (A) above, however, the partitioned water chamber 25 is flat, so that the heat transfer area is small and the heat transfer efficiency is low, and in addition, as there is a clearance between a bottom face of the water tank 22 and that of the heat exchanger 21, convection fault occurs in the water residing in this section, which prevents all portions of the water from being heated evenly. Heat exchange is carried out more smoothly in the heat receiving wall 23 in the side of gas up-draft chamber 29 which is located in the opposite side to the heat receiving wall 23 and where water convection is carried out more smoothly than in the heat receiving wall 23 in the side of gas down-draft chamber 27 which is located near a wall face of the water tank 22 and where water convection is not carried out smoothly, and as a result combustion gas residing in the gas up-draft chamber 29 is cooled, and a satisfactory draft power can hardly be obtained.

Furthermore in the apparatus described above, the exhaust point D (FIG. 12) is located at a position higher by the range h from the exhaust point D, pressures Pu, Pm and Pd at points U, M and D respectively are calculated from the aforesaid equations (1) and (2) as follows.

$$Pu = Pm + \int_0^H \gamma u \cdot SH \quad (3)$$

$$Pd = Pm + \int_0^H \gamma d \cdot SH = Pm + \gamma d \cdot H - \gamma d \cdot h \quad (4)$$

And Pd is released to the atmosphere, Pd=Po (Atmospheric pressure). For this reason, the following equations are provided:

$$Po=Pm+\gamma d.H-\gamma d.h \quad (5)$$

$$Pm=Po-\gamma d.H+\gamma d.h \quad (6)$$

and applying these into the equation (3), the following equation can be obtained.

$$Pu = Po - \gamma d \cdot H + \gamma d \cdot h + \int_0^H \gamma u \cdot SH = \quad (7)$$

-continued $$Po - \gamma d \cdot H + \gamma d \cdot h + \gamma u \cdot H$$

Herein, while operations of the heat exchanger 21 are down, $\gamma d$ is equal to $\gamma u$ ($\gamma d = \gamma u$), so $Pu = Po + \gamma d.h$, namely $Pu - Po = \gamma d.h > 0$, so that the relation of $Pu > Po$ is always maintained, and the combustion gas in the combustion gas path always flow from the heating point U to the middle point M to the exhaust point D without residing in the combustion gas path, and for this reason intrusion of the external air into the inside is not prevented and heat of hot water inside the water tank 22 is radiated to the outside.

The apparatus disclosed in (B) above is like the one shown in FIG. 13 and FIG. 14, wherein an internal drum 67 comprising a dual wall is provided in and at a space from an external drum 66 also comprising a dual wall, a combustion gas down-draft chamber 68 is provided between them, an external water chamber 71 having a hot water outlet port 69 and a water supply port 70 in the upper and lower sections thereof is provided outside of the the combustion gas down-draft chamber 68, a combustion chamber 74 communicating in the upper section thereof to the combustion gas down-draft chamber 68 is provided in the internal drum 67, and exhaust port 75 is provided in the lower section of the combustion gas chamber 68, an exhaust cylinder 78 is connected to this exhaust cylinder 78, and a combustor 77 is provided disconnectably through the inner and outer water chambers 71, 72. The hot water outlet port 69 is connected to hot water reserving sections such as water tanks not shown herein with appropriate pipings, and the numeral 79 indicates a port for cleaning. In the liquid heating apparatus as described above, a combustion gas gradually caused to satisfy the rating by the combustor 77 by means of up/down draft method rises in the combustion chamber 74 with the heat radiated from the combustion gas being absorbed, then reverses in the upper section thereof and flows down at a velocity g (m/sec) in the combustion gas down-draft chamber 68, being accelerated to a velocity G (m/sec) at the exhaust port 75 and exhausted therefrom. On the other hand, water is supplied from the water supply port 70 in the lower section thereof to the outer external water chamber 71, rises in this external water chamber 71 and the internal water chamber 72 communicated thereto with the communicating tubes 73 in the upper and lower sections thereof, while the combustion gas causes the temperature of the liquid to rapidly rise by raising the heat exchange rate between the combustion gas and the liquid because the combustion gas supplies a liquid in the internal and external water chambers 71, 72 with enough quantity of heat by means of radiation and thermal conduction and the down-draft fluidity of the combustion gas in the combustion gas down-draft chamber 68 is raised, which advantageously improves the combustion efficiency and prevents incomplete combustion.

The aforesaid apparatus has the advantages as described above, but at the same time it has problems as described below. Namely in this liquid heating apparatus, as water is supplied from the water supply port 70 located in the lower section thereof to the external water chamber 71 and rises in this external water chamber 71 as well as in the internal water chamber 72 communicated with the communicating tubes 73 in the upper and lower sections thereof to the external water chamber 71, interference is generated between cool water rising in the external water chamber 71 and hot water exhausted in the upper section thereof from the internal water chamber 72 and again descending the external water chamber 71, which prevents water from smoothly convecting in both the internal and external water chambers, and for this reason an efficient heat exchange between the gas and the water can not be achieved, and also as the entire apparatus is monolithically assembled to form a heat exchanging/water reserving section, the work for installation is difficult, and in addition cleaning inside the external water chamber 71 is extremely difficult.

SUMMARY OF THE INVENTION

An object (a) of the present invention is to provide a liquid heating apparatus wherein the heat transfer area is large and the heat efficiency is high, a space between the base of the water tank and that of the heat exchanger is small so that convection fault of water in this section never occurs, water convection within the water tank is smoothly carried out on the entire surface of the heat exchanger for heat exchange to be carried out more smoothly. As a result, combustion gas in the gas descending chamber is efficiently cooled down, draft power is obtained enough to homogeneously heat all portions of the water in the water tank, and furthermore the combustion gas resides inside the heat exchanger even when operation of the heat exchanger is down so that intrusion of cool air from the outside is prevented and with this heat insulating effect, heat of the hot water inside the water tank is not radiated to the outside, thus the problems in the conventional type of liquid heating apparatus as described in (A) above are solved.

An object (b) of the present invention is to provide a liquid heating apparatus, wherein water desends in the external water chamber from the water reserving section in the upper section thereof through the communicating tube in the lower section thereof to the internal water chamber and then rises therein and does not rise in the external water chamber so that generation of interference between cool water and hot water in the internal and external water chambers is suppressed, smooth water convection between the internal and external water chambers is generated, and excellent heat exchange between gas and fluid is performed so that the heat efficiency is high. Also a heat exchange section can be disconnectably mounted in a water reserving section so that the installation work as well as cleaning work is quite easy, thus the problems in the conventional type of the liquid heating apparatus as described in (B) are solved.

In order to achieve the object (a), a liquid heating apparatus according to the present invention comprises a heat exchanger provided in a water tank, wherein said heat exchanger has an external drum comprising a dual wall, this external drum has upper and lower combustion gas distribution chambers formed in the upper and lower sections of the dual wall and a combustion gas down-draft chamber formed therebetween. An internal drum having a combustion chamber therein is provided in and at a space from the external drum, a partitioned water chamber is formed therebetween, an upper communicating tube penetrating the external drum and communicating to inside of the external drum is connected to the upper section of the partitioned water chamber, a lower communicating tube communicating the lower section of the partitioned water chamber to the base of the water tank is provided in the lower section thereof, a draft tube penetrating said partitioned water chamber and communicating the combustion chamber to the combustion gas distribution chamber is provided in the upper section of the partitioned water chamber, an exhaust tube opened to the outside of the water tank is provided in the lower section of the external drum, and a combustor is provided in a combustor support cylinder penetrating the external drum and the partitioned water chamber and thrusting to outside of the water tank is provided on a side wall of the internal drum. In the liquid heating apparatus having the construction as described above, when operation of the exchanger starts and the combustor provided in the combustor support cylinder starts working, a combustion gas generated in the combustion chamber rises in the internal drum, goes into the upper combustion gas distribution chamber formed by the dual wall of the external drum via the upper draft tube, then is reversed at the upper periphery of said combustion gas distribution chamber and descends in the combustion gas down-draft chamber, enters the lower combustion gas distribution chamber and is exhausted to the outside from the exhaust tube. While the combustion gas rises and descends in the heat exchanger as described above, heat exchange is carried out between the combustion gas and water residing in the partitioned water chamber formed between the internal and external chambers as well as on the external surface of the external drum, and because of this heat exchange, combustion gas in the combustion gas down-draft chamber delivers heat to the liquid in the inner and outer sides thereof with the down-draft fluidity being raised and also the combustion efficiency being improved to prevent incomplete combustion. During this process the liquid residing in the partitioned water chamber and on the external surface of the external drum generates convection in which water in the partitioned water chamber and in the outside rises and descends, and for this reason the heat exchange rate between the combustion gas and the liquid is raised. With temperature of the water raised, operation of the heat exchanger is stopped, and even if the combustion gas residing inside is trying to move from the exhaust point to the middle point and to the heating point, namely in the contrary direction to that when the heat exchanger is started, the combustor provided in the combustor support cylinder suppresses the movement so that the combustion gas resides in the heat exchanger to prevent intrusion of cool air from the outside and also to provide a heat insulating effect, so that heat of hot water in the water tank will never be radiated to the outside.

Also in order to achieve the other object (b) of the present invention, the liquid heating apparatus according to the present invention has a water reserving section and a heat exchanger disconnectably connected to the lower section thereof, the aforesaid heat exchanger has an intermediate drum comprising a dual wall with an external water chamber formed between the intermediate drum and the external drum, this intermediate drum has upper and lower combustion gas distribution chambers formed in the upper and lower sections of the dual wall and a combustion gas down-draft chamber between the two combustion gas distribution chambers, an internal drum having a combustion chamber therein is provided in and at a space from the intermediate drum, an internal water chamber is arranged therebetween, an upper communicating tube penetrating the intermediate drum and communicating to the water reserving section is provided in the upper section of the internal water chamber, a lower communicating tube communicating the lower section of the internal water chamber to the lower section of the external water chamber is provided in the lower section thereof, a draft tube penetrating said internal water chamber and communicating the combustion chamber to the combustion gas distribution chamber is provided in the upper section of the internal water chamber, and also the apparatus has an exhaust tube penetrating the lower section of the external drum, communicating to the lower combustion gas distribution chamber, and opened to the outside. In the liquid heating apparatus having the construction as described above, when operation of the heat exchanger combustor is started and the combustor starts working, a combustion gas generated in the combustion chamber rises in the combustion chamber, is reversed when it enters via the draft tube into the upper combustion gas distribution chamber, descends in the combustion gas down-draft chamber, and is exhausted from the exhaust tube to the outside, and on the other hand water in the water reserving section descends in the external water chamber between a partitioning plate and the external drum, rises via the lower communicating tube in the internal water chamber, and is discharged via the upper communicating tube to the water reserving section. During this process, the combustion gas delivers an adequate quantity of heat to the liquid in the internal and external water chambers, thus the down-draft fluidity in the combustion gas down-draft chamber being raised and also the combustion efficiency being improved so that incomplete combustion is prevented. Also water flows from the upper water reserving section to the external water chamber to the lower communicating tube to the internal water chamber to the upper communicating tube, and to the water reserving chamber. During this process, generation of an interference between cool water and hot water in the external water chamber is suppressed, smooth convection of water is generated between the internal and external water chambers, active heat exchange between the gas and the liquid is performed with the heat efficiency being improved, and the heat exchange rate between the combustion gas and the liquid is raised so that the temperature of the liquid is rapidly raised. If checking, repairing, and replacement are required in the heat exchanger, the work can be carried out after the heat exchanger is removed from the water reserving section. Also a combustion support cylinder penetrating the partitioned water chamber, the intermediate drum and the external drum and thrusting to outside of the water tank is provided on a side wall of the internal drum, and a combustor is disconnectably provided in this combustor support cylinder, so that, when operation of the combustor is stopped, even if the combustion gas residing inside the combustor tries to move from the exhaust point (exhaust tube) to the middle point to the heating point (combustor), namely in the direction contrary to that when operation of the heat exchanger is started, the combustor provided in the combustor support cylinder suppresses the movement and causes the water to stay inside the heat exchanger, so that intrusion of cool air from the outside is prevented and a heat insulating effect is provided, and for this reason heat of hot water inside the apparatus will never be radiated to the outside.

BRIEF DESCRIPTION OF THE PREFERRED EMBODIMENT

Figure 1:
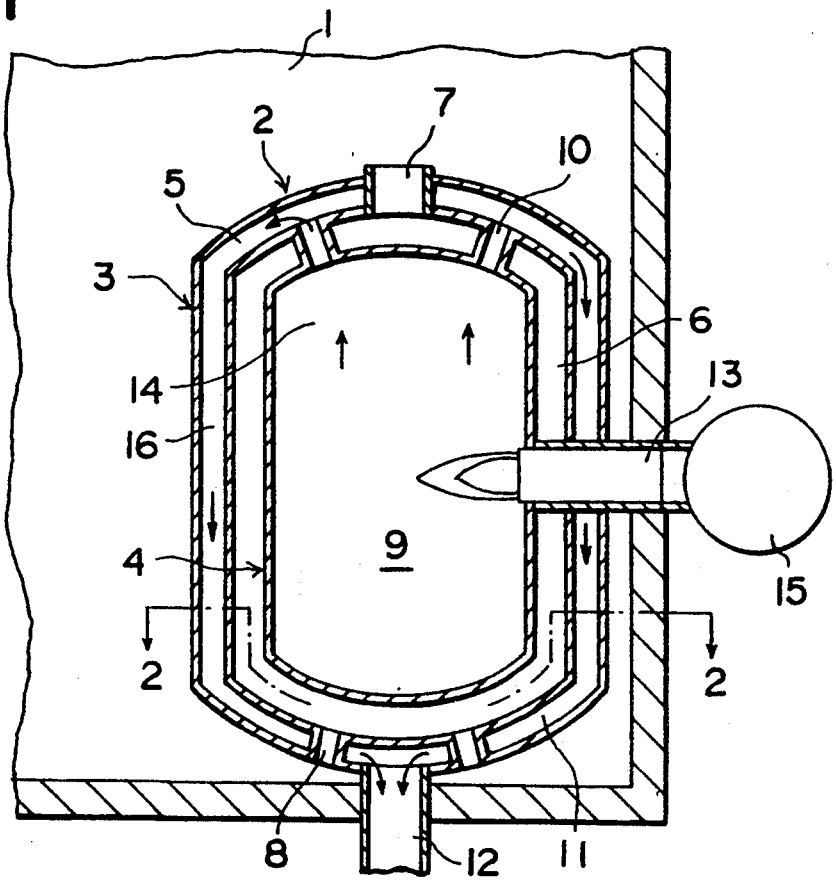
FIG. 1 is a transverse front view of a first embodiment of the present invention.
Figure 2:
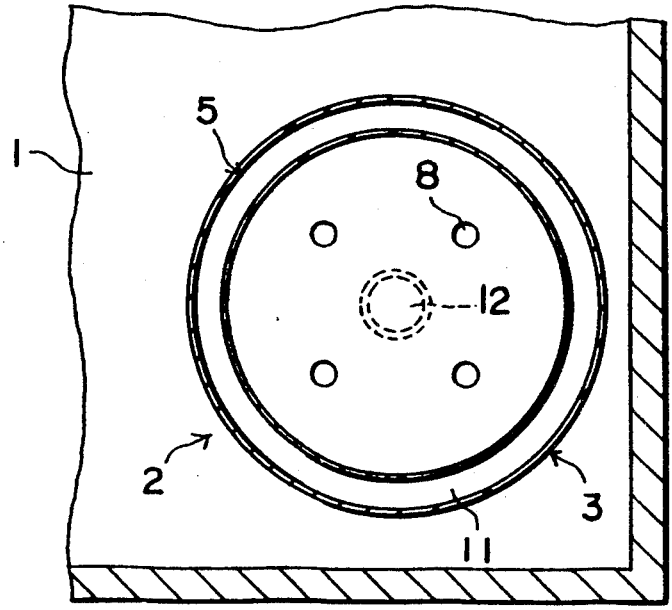
FIG. 2 is a sectional view of the same taken in the line 2—2 of FIG. 1.

In the first embodiment shown in FIG. 1, the numeral 1 indicates a water tank, the numeral 2 indicates a heat exchanger provided in this water tank 1, this heat exchanger 2 has an external drum 3 comprising a dual wall, this external drum 3 has upper and lower combustion gas distribution chambers 5,11 in the upper and lower sections of the dual wall, a combustion gas down-draft chamber 16 is formed therebetween, internal drum 4 with a combustion chamber 9 and a combustion gas up-draft chamber 14 formed therein is provided in and at a space from the external drum, a partitioned water chamber 6 is formed between the external drum 3 and the internal drum 4, an upper communicating tube 7 penetrating the external drum 3 and communicating to inside of the water tank 1 is connected to the upper section of the partitioned water chamber 6, a lower communicating tube 8 communicating the lower section of the partitioned chamber 6 to the base of the water tank 1 is provided in the lower section of the external drum 3, an upper draft tube 10 penetrating said partitioned water chamber 6 and communicating the combustion gas chamber 9 to the combustion gas distribution chamber 5 is provided in the upper section of the partitioned water chamber 6, an exhaust port 12 opened to the outside of the water tank is provided in the lower section of the drum 3, a combustion support cylinder 13 penetrating the partitioned water chamber 6 and thrusting to the outside of the water tank 1 is provided on a side wall of the internal drum 4, and a combustor 15 is disconnectably provided in this combustor support cylinder 13.

Figure 5:
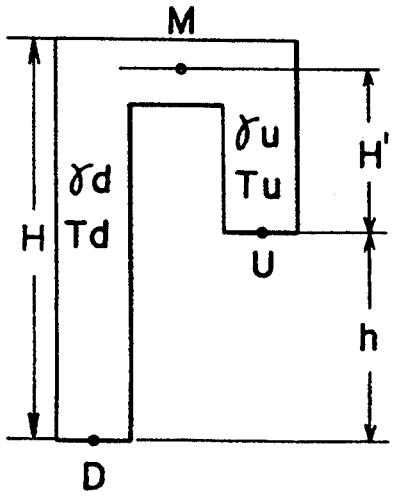
FIG. 5 is a drawing illustrating positional relations between a heating point, a middle point, and an exhaust point in the same.

In a liquid heating apparatus having the construction as described above, when operation of the heat exchanger 2 is started and the combustor 15 provided in the combustor support cylinder 13 starts working, a combustion gas generated in the combustion chamber 9 rises in the internal drum 4 and the combustion gas up-draft chamber 14, enters the upper combustion gas distribution chamber 5 formed by a dual wall of the external drum via the upper draft tube 10, is reversed at the upper periphery of said combustion gas distribution chamber 5 and descends in the combustion gas down-draft chamber 16, enters the lower combustion gas distribution chamber 11 and is exhausted to the outside from the exhaust tube 12. While the combustion gas rises and descends in the heat exchanger 2 as described above, heat exchange is carried out between the combustion gas and the liquid residing on the external surface of the external drum 3 and in the water tank 1, the combustion gas in the combustion gas down-draft chamber 16 delivers heat to liquids in and out thereof through this heat exchange, so that the down-draft fluidity is raised with the combustion efficiency being improved, and during this process the liquid residing in the partitioned water chamber and on the external surface of the drum 3 generates convection in which said liquid in and out of the partitioned water chamber 6 rises and descends via the upper and lower communicating tubes 7, 8, so that the heat exchange rate with the combustion gas is raised and temperature of the liquid is rapidly raised. Also as shown in FIG. 5, the height H' of the middle point M from the heat generating point U is shorter by h than the aforesaid height H or alternatively the exhaust point D is a distance by h lower than the heat generating point U, so that, when operation of the heat exchanger 2 is down, theoretically even if the combustion gas residing in the inside thereof tries to move from the exhaust point D to the middle point M to the heating point U like in prior-art -based liquid heating apparatuses, namely in the direction contrary to that when the heat exchanger 2 is operating, to flow out of the apparatus, the combustor 15 provided in the combustor support cylinder 13 suppresses the distribution, and for this reason the combustion gas continues to stay in the heat exchanger 2, which prevents cool air from coming in from the outside and provides a heat insulating effect, and as a result heat of hot water in the water tank 1 will never be radiated to the outside.

Figure 3:
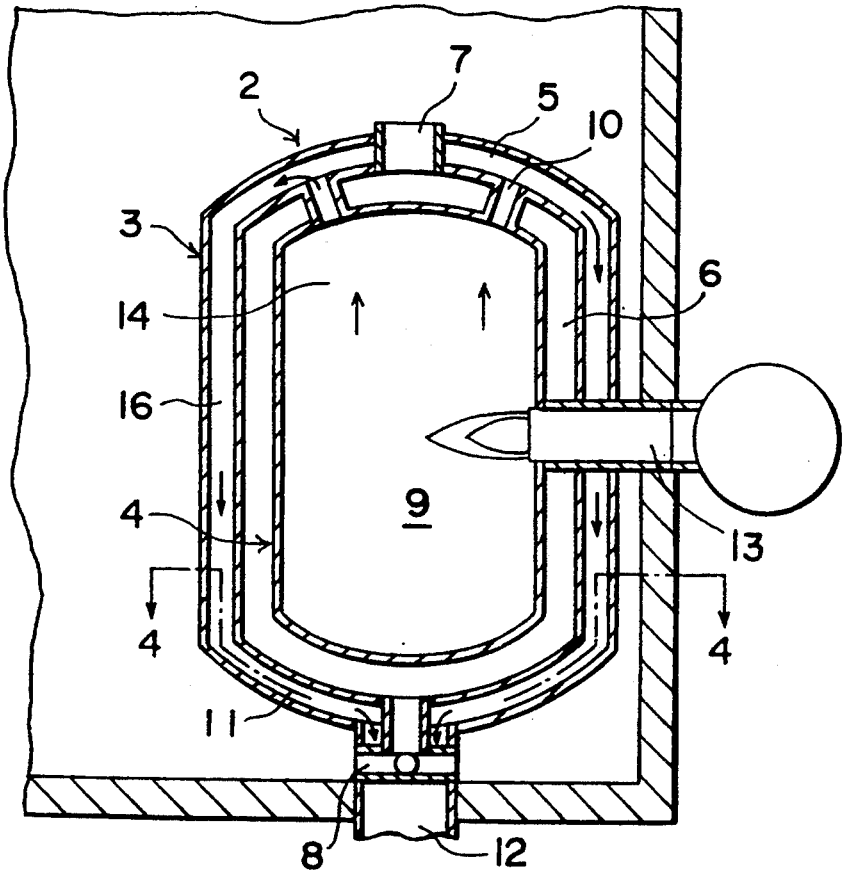
FIG. 3 is a transverse front view of a second embodiment of the present invention.
Figure 4:
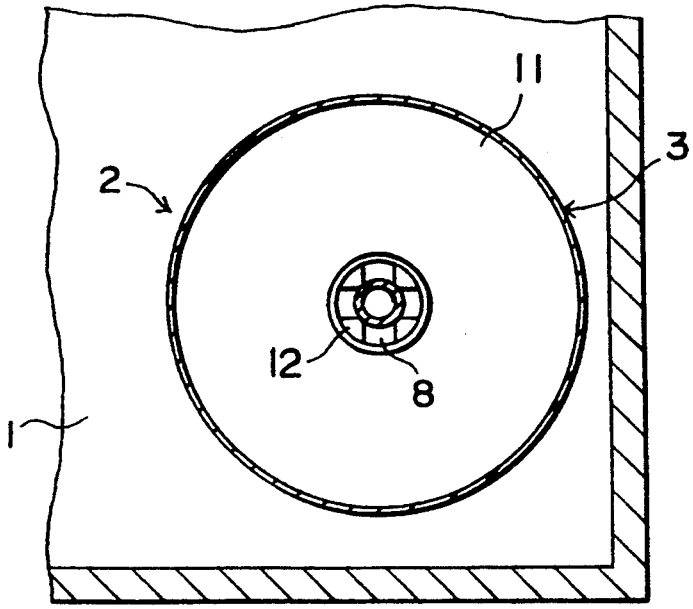
FIG. 4 is a section view of the same taken in the line 4—4 of FIG. 3.

In the second embodiment of the present invention shown in FIG. 3 and FIG. 4, the lower communicating tube 8 is provided in the exhaust tube 12 in the lower section of the external drum 3, and for this reason the embodiment is not different from the first embodiment, excluding the point that so-called "the dead water" is not generated because the liquid at a base of the water tank 1 is more smoothly distributed and efficiently taken into the heat exchanger 2.

In these embodiments, one heat exchanger 2 is provided to one water tank, but a plurality of heat exchangers 2 may be provided to one water tank, so that the present invention can advantageously be applied to a bath, a hot water swimming pool, a boiler based on a water reserving system, a movable bath, a constant temperature bath, a vapor generator, an absorption refrigerator, a vapor generator, a hot chemicals bath, a hot culturing tank, a concrete solution heating apparatus, and others.

Figure 6:
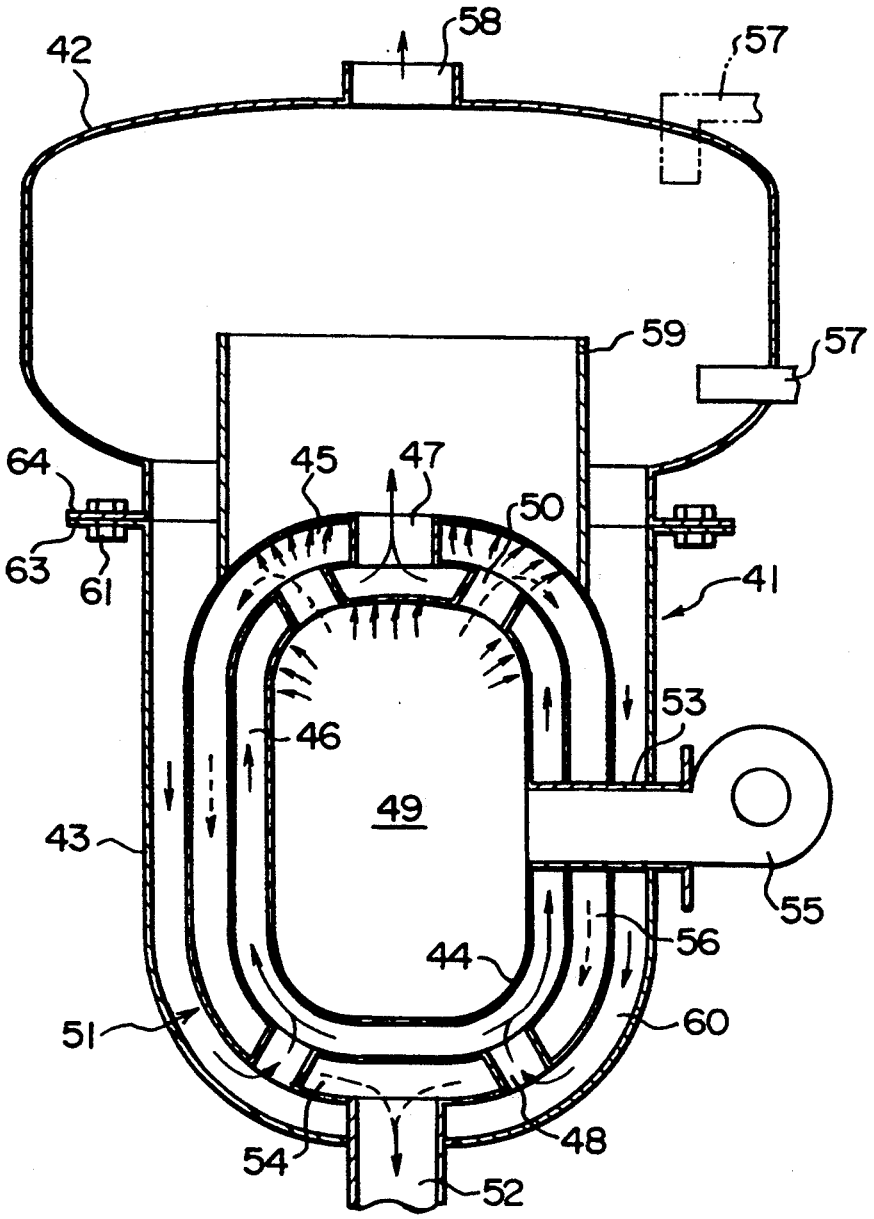
FIG. 6 is a transverse front view of a third embodiment of the present invention.

In FIG. 6 illustrating the third embodiment of the present invention, the numeral 41 indicates a heat exchanger, the numeral 42 indicates a water reserving section 42 provided disconnectably in the upper section thereof, the heat exchanger 41 has an intermediate drum 51 comprising a dual wall with an external water chamber 60 provided between said intermediate drum 51 and an external drum 43, this intermediate drum 51 has upper and lower combustion gas distribution chamber 45 formed in the upper and lower sections of the dual wall and a combustion gas down-draft chamber 56 formed therebetween, an internal drum 44 having a combustion chamber 49 therein is provided in and at a space from the intermediate drum 51, an internal water chamber 46 is formed therebetween, an upper communicating tube 47 penetrating the intermediate drum 51 and communicating to a water reserving section 42 is provided in the upper section of this internal water chamber 46, a lower communicating tube 48 communicating the lower section of the internal water chamber 46 to the base of the external water chamber 60 is provided in the lower section thereof, a draft tube 50 penetrating said internal water chamber 46 and communicating the combustion chamber 49 to the upper combustion gas distribution chamber 45 is provided in the upper section of the internal water chamber 46, an exhaust tube 52 penetrating the lower section of the external drum, communicating to the lower combustion gas distribution chamber 54, and opened to the outside is provided, a combustor support cylinder 53 penetrating the intermediate drum 51 and the external drum 43 and thrusting to outside of the heat exchanger 41 is provided, a combustor 55 is disconnectably provided in the combustor support cylinder 53, and a cylindrical partitioning plate 59 extending to inside of the water reserving section 42 is provided in the upper section of the external drum 43. In the water reserving section 42, a water supply pipe 57 is provided in the lower section thereof, and a hot water outlet port 58 is provided in the upper section thereof. The heat exchanger 41 is disconnectably connected to the water reserving section 42 by connecting the flanges 63 and 64 each provided in the upper section of the heat exchanger 41 and the water reserving section 42 respectively. generated in the combustion chamber 49 rises in the combustion chamber 49, is reversed when it enters the upper combustion gas distribution chamber 45 via the draft tube 50 and descends in the combustion gas down-draft chamber 56, and is exhausted to the outside via the lower combustion gas distribution chamber 54 from the exhaust tube 52. On the other hand, water is supplied via a water supply tube 57 into the water reserving section 42, descends in the external water chamber 60 between a partitioning plate 59 and the external drum 43, rises via the lower communicating tube 48 in the internal water chamber 46, and is exhausted via the upper communicating tube 47 into the the water reserving tube 47, and during this process temperature of cool water in the external water chamber does not rise, significantly so that interference between the cool water and hot water is suppressed, smooth convection of water between the internal and external water chambers 46 and 60 is generated, the combustion gas delivers enough quantity of heat to the liquid in the internal and external water chambers 46, 60, so that the down-draft fluidity is raised with the combustion efficiency being improved, incomplete combustion is prevented, and thus appropriate heat exchange between a gas and a liquid is carried out, the heat efficiency is raised, and temperature of the liquid is rapidly raised. Also if it is necessary to perform work such as checking, repairing and replacement inside the heat exchanger 41, the work is carried out after the heat exchanger 41 is removed from the water reserving chamber 42. Also a combustion support cylinder penetrating the partitioned water chamber, the intermediate water chamber, and the external drum is provided on a side wall of the internal drum, and a combustor is disconnectably provided in this combustor support cylinder, so that, when operation of the combustor is down, even if the combustion gas residing inside thereof tried to move from the exhaust point (exhaust tube) to the middle point to the heating point (combustor), namely in the direction contrary to that when the heat exchanger is working, the combustor provided in the combustor support cylinder prevents its distribution and cause the combustion gas to reside in the heat exchanger, so that intrusion of cool air from outside is prevented, a heat insulating effect is provided, and for this reason heat of hot water in the apparatus is not radiated to the outside.

Figure 7:
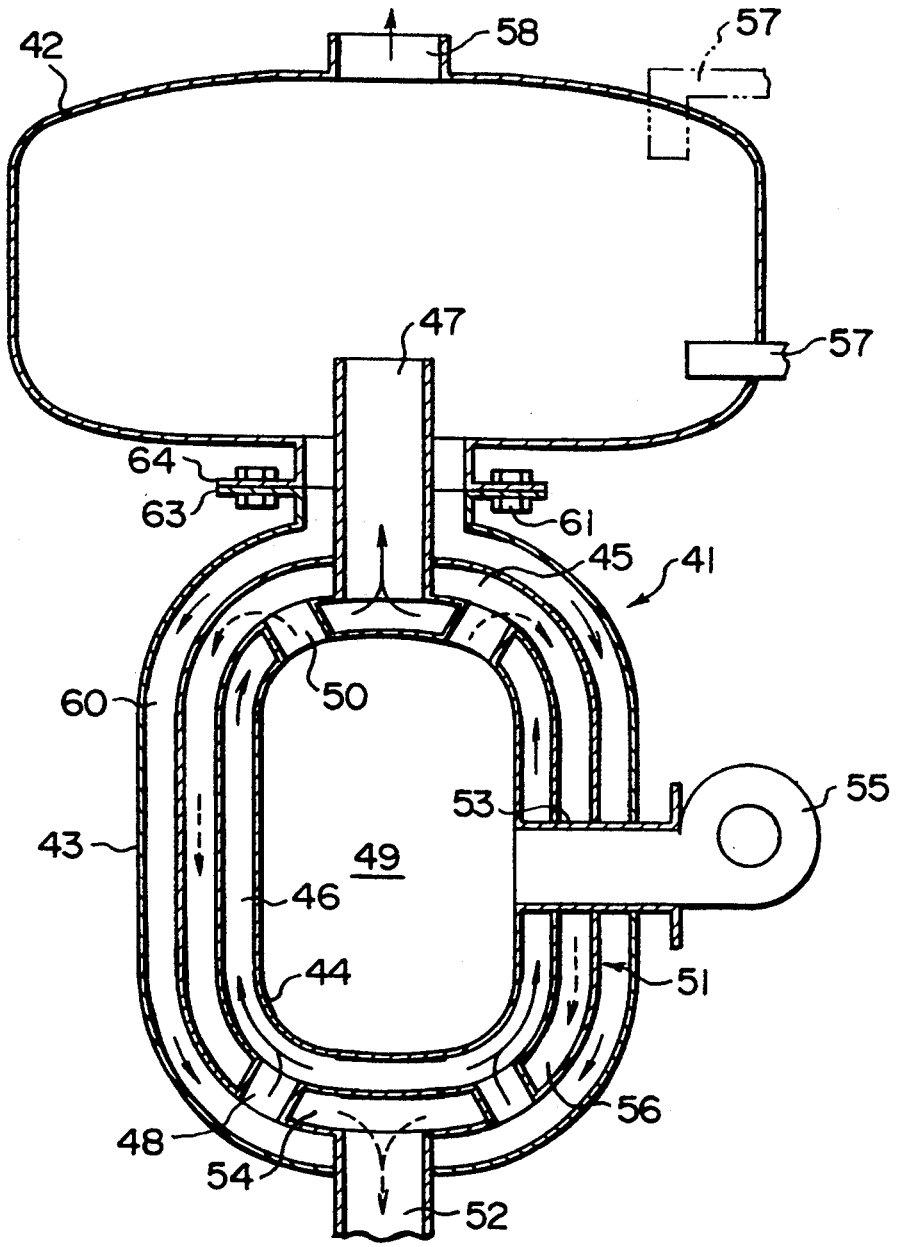
FIG. 7 is a transverse front view of a fourth embodiment of the present invention.

The fourth embodiment of the present invention shown in FIG. 7 has almost the same configuration as that of the third embodiment, and a difference thereof is a point that the upper communicating tube 47 also functions as a partitioning plate, and other points including its effect are not different, so that description of the fourth embodiment is omitted herein.

Figure 8:
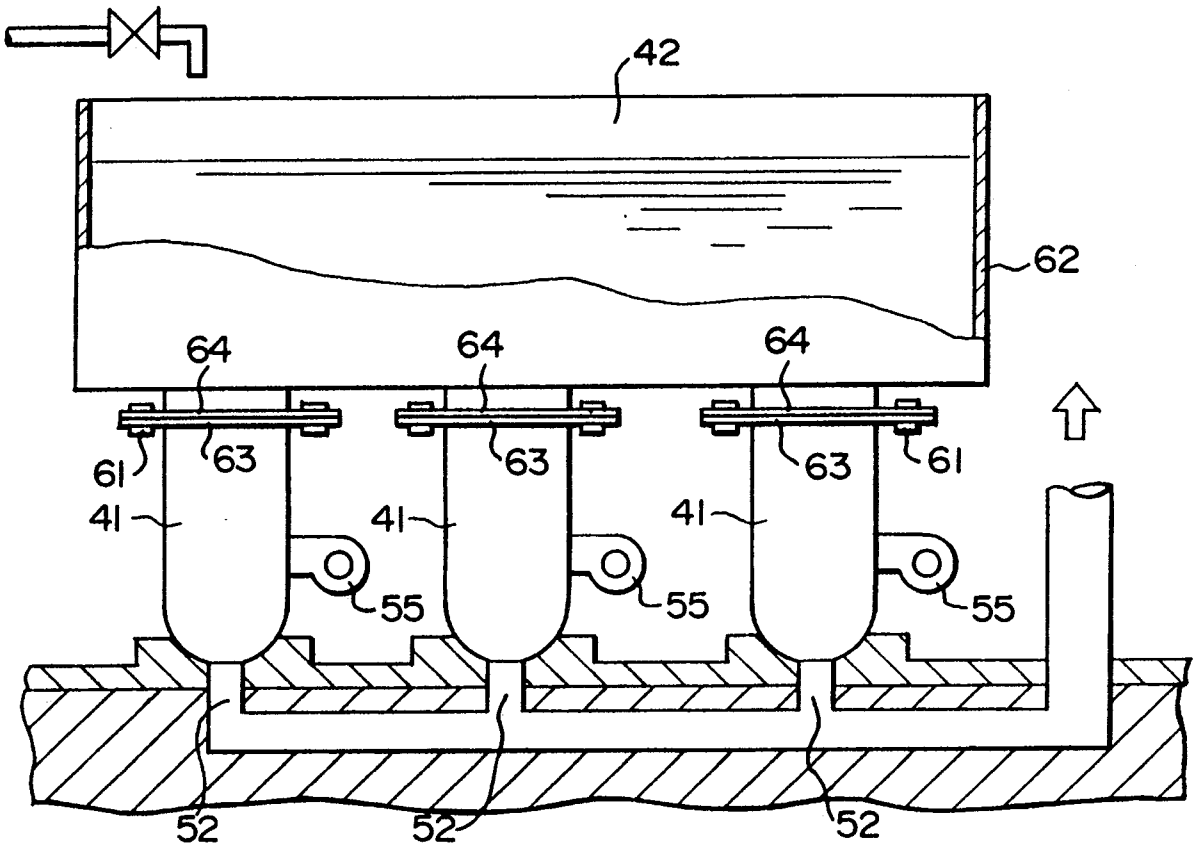
FIG. 8 is a front view of a fifth embodiment of the present invention.
Figure 9:
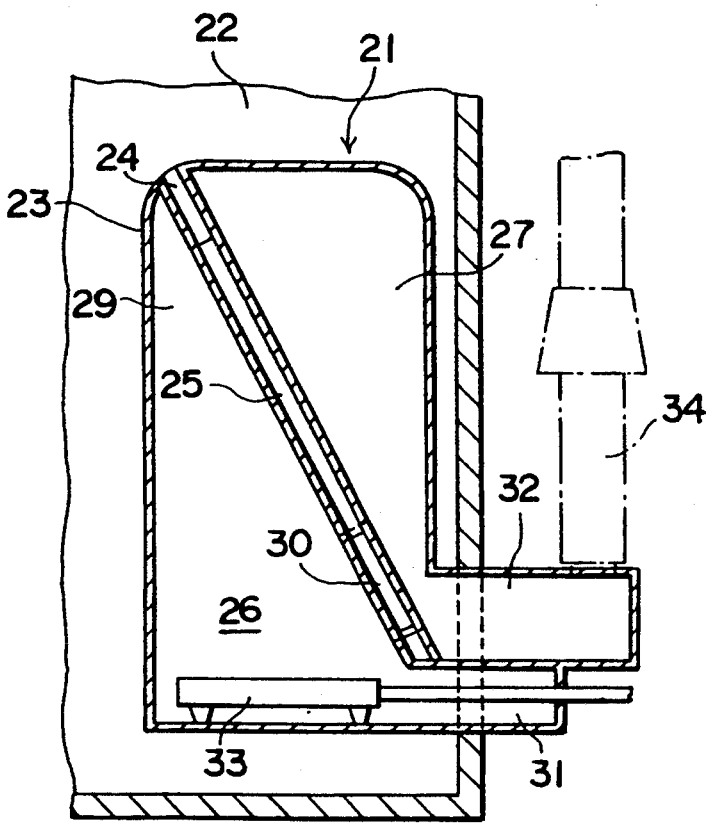
FIG. 9 PRIOR ART
FIG. 9 is a transverse front view of a conventional type of liquid heating apparatus which is similar to the one according to the present invention.
Figure 10:
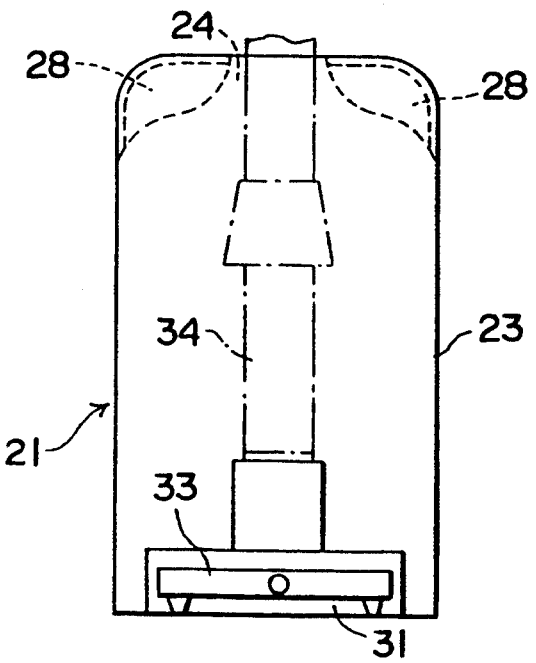
FIG. 10 PRIOR ART
FIG. 10 is a side view of a heat exchange in the same.
Figure 11:
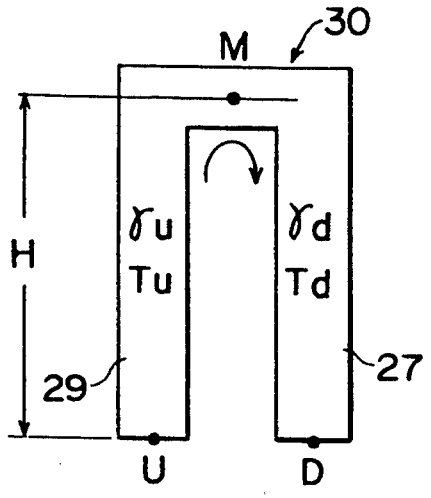
FIG. 11 PRIOR ART
FIG. 11 is a sectional view illustrating a general up/-down-draft phenomenon of a combustion gas in the same.
Figure 12:
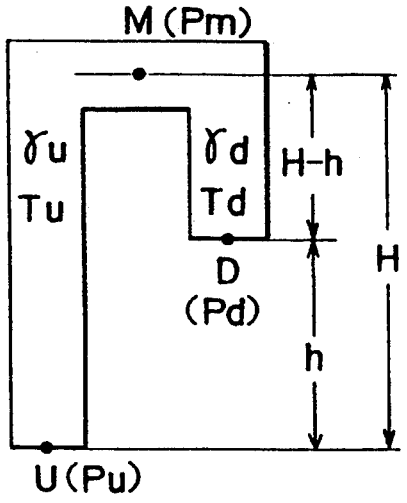
FIG. 12 PRIOR ART
FIG. 12 is a sectional view illustrating a up/down-draft phenomenon in the heat exchange shown in FIG. 9 and FIG. 10.
Figure 13:
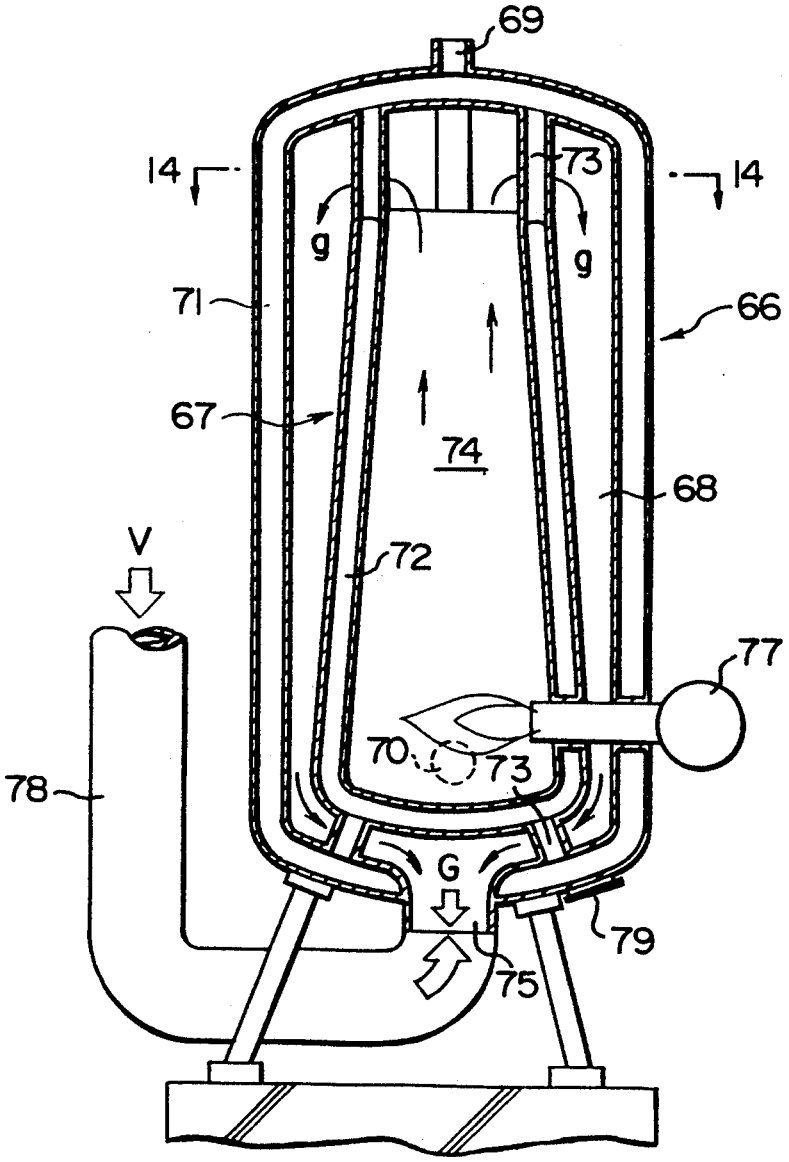
FIG. 13 PRIOR ART
FIG. 13 is a transverse front view of another liquid heating apparatus based on the prior art which is similar to the one according to the present invention.
Figure 14:
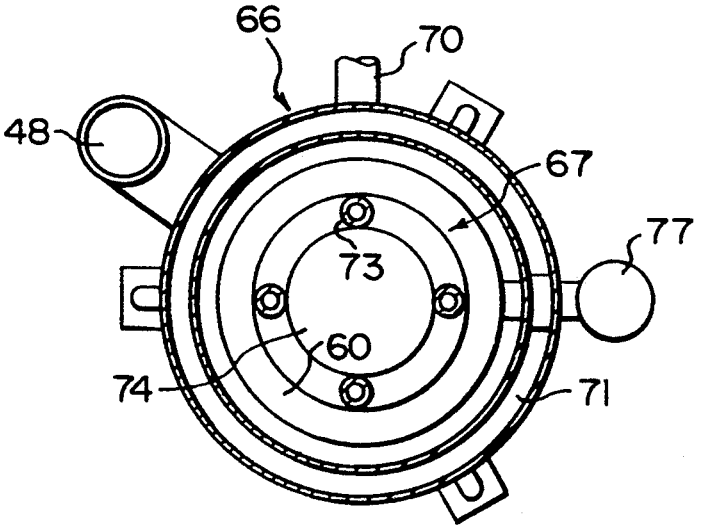
FIG. 14 PRIOR ART
FIG. 14 is a sectional view of the same taken in the line 14—14 of FIG. 13.

In the fifth embodiment of the present invention shown in FIG. 8, the water reserving section 42 has a big water reserving body 62 like a big bath or a hot water swimming pool, and in a case like this, a plurality of flanges 64 are mounted on the base of the water reserving body 62, a flange 63 for each individual heat exchanger 41 is connected with a bolt and nut 61, and if work for checking, repairing, or replacement is required for each of the heat exchangers 41, the work is carried out after only the corresponding heat exchanger 41 is removed from the water reserving section 42. Thus the present application is useful when applied to such devices as a bath, a hot water swimming pool, a boiler based on a reserving system, a moving bath, a constant temperature bath, a vapor generator, a thermal chemicals bath, a thermal culture bath, a concrete solution heating apparatus, and a boiler for cooking.

What is claimed is:

1. A submersible heat exchanger in a liquid-containing tank having a bottom wall and a side wall, said submersible heat exchanger comprising:

a combustion chamber having top, bottom and side walls;

a liquid chamber disposed concentrically about the combustion chamber and having top, bottom and side walls;

a combustion gas descending chamber disposed concentrically about the liquid chamber and having an outer surface and top, bottom and side walls;

a draft tube disposed through the top wall of the combustion chamber and the top wall of the combustion gas descending chamber so as to provide communication therebetween;

an exhaust tube disposed between the bottom wall of the tank and the bottom wall of the combustion gas descending chamber so that the combustion gas descending chamber is in communication with the atmosphere;

a liquid inlet tube disposed between the bottom wall of the combustion gas descending chamber and the bottom wall of the liquid chamber so that the liquid in the tank is in communication with the liquid chamber;

a liquid outlet tube disposed between the top wall of the liquid chamber an the top wall of the combustion gas descending chamber so that the liquid chamber is in communication with the liquid in the tank; and wherein the combustion gas descending chamber is disposed in a spaced relation with the bottom wall and side wall of the tank so that liquid contained in the tank may flow freely into the liquid inlet tube and over the outer surface of the combustion gas descending chamber.

2. The submersible heat exchanger of claim 1 further comprising:

a combustion support cylinder disposed between the tank wall and the combustion chamber so that the combustion chamber is accessible from outside of the tank; and a combustor disposed in the combustion support cylinder.

3. The submersible heat exchanger of claim 2 having a plurality of said heat exchangers disposed in a water tank.

4. The submersible heat exchanger of claim 2 wherein the liquid inlet tube is provided in the exhaust tube.

5. A liquid heating apparatus comprising:

(a) a heat exchanger having;

a combustion chamber having top, bottom and side walls;

an inner liquid chamber disposed concentrically about the combustion chamber and having top, bottom and side walls;

a combustion gas descending chamber disposed concentrically about the liquid chamber and having an outer surface and top, bottom and side walls;

an outer liquid chamber disposed concentrically about the combustion gas descending chamber and having bottom and side walls;

a draft tube disposed through the top wall of the combustion chamber and the top wall of the combustion gas descending chamber so as to provide communication therebetween;

an exhaust tube disposed through the bottom wall of the combustion gas descending chamber and the bottom wall of the outer liquid chamber so that the combustion gas descending chamber is in communication with the atmosphere;

a liquid inlet tube disposed between the bottom wall of the combustion gas descending chamber and the bottom wall of the inner liquid chamber so that the liquid in the outer liquid chamber is in communication with the inner liquid chamber; and a liquid outlet tube disposed between the top wall of the inner liquid chamber and the top wall of the combustion gas descending chamber; and (b) a liquid reserving section having a hot liquid outlet port and a liquid supply pipe disposed above the heat exchanger and coupled to the top of the outer liquid chamber so that the liquid reserving section is in communication with the outer liquid chamber and the liquid outlet tube and so that liquid contained in the reserving section may flow freely through the outer water chamber, liquid inlet tube, inner liquid chamber and liquid outlet tube.

6. The liquid heating apparatus of claim 5 further comprising a cylindrical partitioning plate extending upward from the top wall of the combustion gas descending chamber and into the liquid reserving section a sufficient distance to prevent areas of stagnant liquid in the reserving section.

7. The liquid heating apparatus of claim 6 further comprising:

a combustion support cylinder disposed between the outer liquid chamber and the combustion chamber so that the combustion chamber is accessible from outside of the outer liquid chamber; and a combustor disposed in the combustion support cylinder.

8. The liquid heating apparatus of claim 7 having a plurality of heat exchangers disconnectably connected to the water reserving section.

9. The liquid heating apparatus of claim 7 wherein the water reserving section has a water supply tube and a hot water outlet port.

* * * * *

UNITED STATES PATENT AND TRADEMARK OFFICE

CERTIFICATE OF CORRECTION

PATENT NO. : 5,341,797

DATED : August 30, 1994

INVENTOR(S) : Noboru Maruyama

It is certified that error appears in the above—identified patent and that said Letters Patent is hereby corrected as shown below:

Column 2, Equation 3, should read as follows:

$$Pu = Pm + \int_{o}^{H} \gamma u \cdot dH \qquad (3)$$

Column 2, Equation 4, should read as follows:

$$Pd = Pm + \int_{o}^{H} \gamma d \cdot dH = Pm + \gamma d \cdot H - \gamma d \cdot h \qquad (4)$$

UNITED STATES PATENT AND TRADEMARK OFFICE

CERTIFICATE OF CORRECTION

PATENT NO. : 5,341,797

DATED : August 30, 1994

INVENTOR(S) : Noboru Maruyama

It is certified that error appears in the above-indentified patent and that said Letters Patent is hereby corrected as shown below:

Column 2, Equation 7, should read as follows:

$$Pu = Po - \gamma d \cdot H + \gamma d \cdot h + \int_{o}^{H} \gamma u \cdot dH = \qquad (7)$$

Signed and Sealed this

Seventh Day of March, 1995

*Attest:*

*Attesting Officer*

BRUCE LEHMAN

*Commissioner of Patents and Trademarks*